US006883195B1

(12) United States Patent
Gustavsen

(10) Patent No.: US 6,883,195 B1
(45) Date of Patent: Apr. 26, 2005

(54) REMOVABLE RESCUE BOARD PATIENT SUPPORT

(76) Inventor: Hans P. Gustavsen, 1071 Westfield Way, Mundelein, IL (US) 60060

( * ) Notice: Subject to any disclaimer, the term of this patent is extended or adjusted under 35 U.S.C. 154(b) by 0 days.

(21) Appl. No.: 10/733,633

(22) Filed: Dec. 11, 2003

(51) Int. Cl.[7] ..... A61G 1/04; A61G 1/003; A61G 1/048

(52) U.S. Cl. ..... 5/626; 5/651

(58) Field of Search ..... 5/625, 626, 627, 5/628, 651; 128/845, 882, 869, 870; 280/47.131, 79.7

(56) References Cited

U.S. PATENT DOCUMENTS

| | | | | | |
|---|---|---|---|---|---|
| 2,351,146 | A | | 6/1944 | Pike | |
| 3,021,837 | A | | 2/1962 | Newell | |
| 3,629,581 | A | | 12/1971 | Smith | |
| 4,369,982 | A | * | 1/1983 | Hein et al. | 280/47.131 |
| 5,109,872 | A | | 5/1992 | Conn | |
| 5,179,746 | A | | 1/1993 | Rogers | |
| 5,201,089 | A | | 4/1993 | Ferreira | |
| 5,603,336 | A | | 2/1997 | Shepich | |
| 5,871,220 | A | * | 2/1999 | Lombard | 280/79.7 |
| 6,295,672 | B1 | | 10/2001 | Vassallo, Jr. | |
| 6,357,063 | B1 | * | 3/2002 | Selby | 5/626 |

* cited by examiner

*Primary Examiner*—Alexander Grosz
(74) *Attorney, Agent, or Firm*—Cardinal Law Group

(57) ABSTRACT

A patient support apparatus includes a back board receiving unit including a base portion having a back board receiving pocket formed therein and a footrest portion extending from the base portion; and a back board removably received in the back board receiving pocket. The back board support may include a locking apparatus to secure the backboard to the patient support.

16 Claims, 2 Drawing Sheets

REMOVABLE RESCUE BOARD PATIENT SUPPORT

FIELD OF THE INVENTION

This invention relates generally to emergency medical devices. More specifically, the invention relates to a portable and removable patient support to be utilized with a rescue board.

BACKGROUND OF THE INVENTION

Patient transport devices are widely used by medical personnel including doctors, nurses, medical technicians and paramedics. Common patient transport devices include gurneys, stretchers and rescue boards. Emergency medical technicians (EMT) and paramedics often use rescue boards at the scene of accidents and other places away from a hospital, such as homes and places of work.

Emergencies can happen at any time and in any place, often requiring the transport of a patient under less than ideal circumstances. For example, patients may need to be transported up or down stairs, through narrow spaces, around tight corners and over rough rural terrain. These circumstances may also include urban structural collapse caused by a natural occurrence or from an attack. In these situations, the patient may need to be carried in a manner that places the board in a more vertical position. For example, a patient that is transported down a steep winding staircase may need the board to be tilted at a great angle to maneuver down the stairs. Without proper patient support, the patient may slip towards the end of the board. Further, patients that are tall may slip so much that their feet and lower legs extend beyond the end of the board compromising patient immobilization.

Proper technique for loading patients depends on the perceived or actual injury involved. For example, under some circumstances a conscious patient may need to be strapped onto a rescue board (back board) while the patient is standing. The patient is then lowered into a horizontal position. Without proper patient support of the feet the patient may slip towards the end of the board as it is lowered into the horizontal position. Movement of the patient in this manner may compromise the health of the patient and may aggravate any existing injury.

U.S. Pat. No. 6,295,672 to Vassallo discloses a removable spine board foot support. However, this board does not allow for standing patient immobilization, requiring that it be used with a specific board due to the method of attachment and reducing the usable length of the board. Further, it is not easily removable to allow for medical testing of the feet as is often required to access the nature of the patient's injuries.

U.S. Pat. No. 5,179,746 to Rogers discloses a stretcher having a foot support. However, once the patient is secured to the stretcher the foot support cannot be removed to examine the feet as may be required due to the injury sustained by the patient. Further, the foot support is an integral part of the stretcher which does not allow for its removal when not in use, thereby unnecessarily adding to the weight that may need to be transported by rescue personnel.

U.S. Pat. No. 5,201,089 to Ferreira also discloses a foot support for a stretcher. However, this support requires that the board be modified to enable attachment or requires a specific board. This does not allow for the use of the foot support across multiple types of rescue boards that may be utilized by medical care personnel. Further, this support is not easily attached and removed from the rescue board and blocks access to handles located at the foot end of the board making it harder to carry when a patient is secured.

Other devices that are currently available are bulky and heavy. For many rescue and emergency response teams space availability within the vehicle and the total weight of equipment on the vehicle is an issue. Thus, equipment that is heavy or consumes too much space is undesirable, and a suitable alternative is not presently available.

It is desirable, therefore, to provide a patient support apparatus that overcomes these and other disadvantages.

SUMMARY OF THE INVENTION

The invention provides for a patient support apparatus and a method of manufacture of the patient support apparatus. The patient support apparatus includes a back board receiving unit that includes a board support portion that forms a back board receiving pocket and a footrest portion extending from the board support portion. A back board is removably received in the back board receiving pocket.

The invention further provides a patient support apparatus comprising back board receiving unit means for removably receiving a back board, patient support means and a back board removably received in the back board receiving means.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
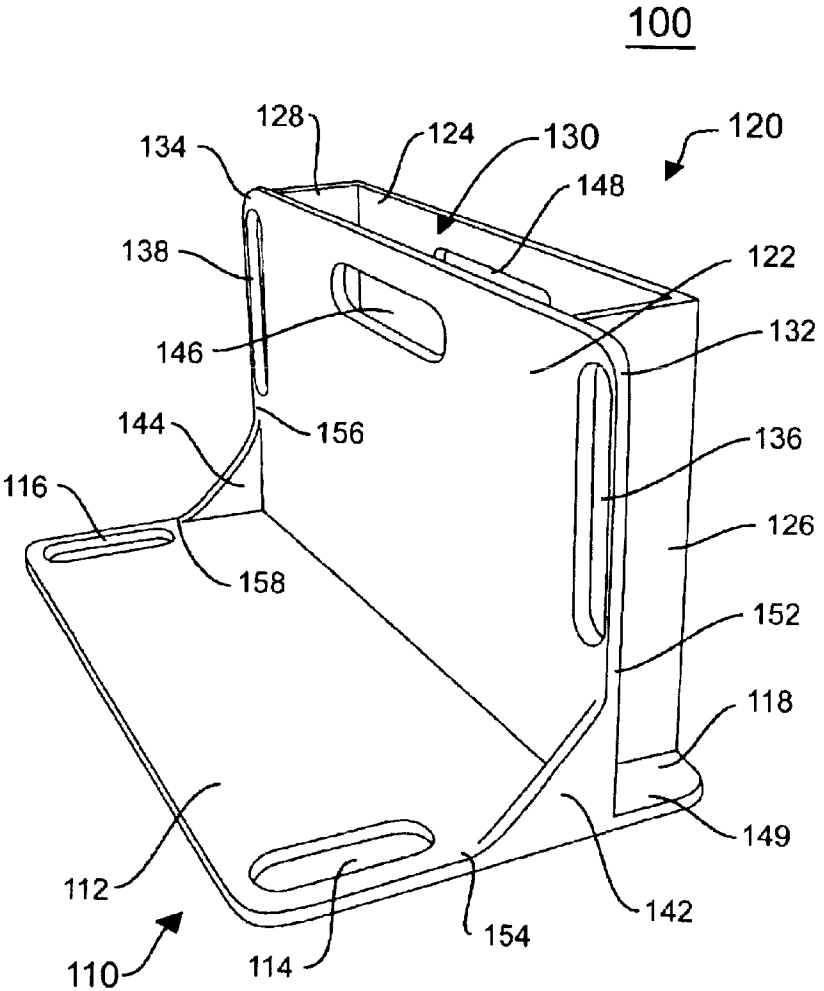
FIG. 1 illustrates a perspective view of the front side of one embodiment of a rescue board patient support in accordance with the invention.
Figure 2:
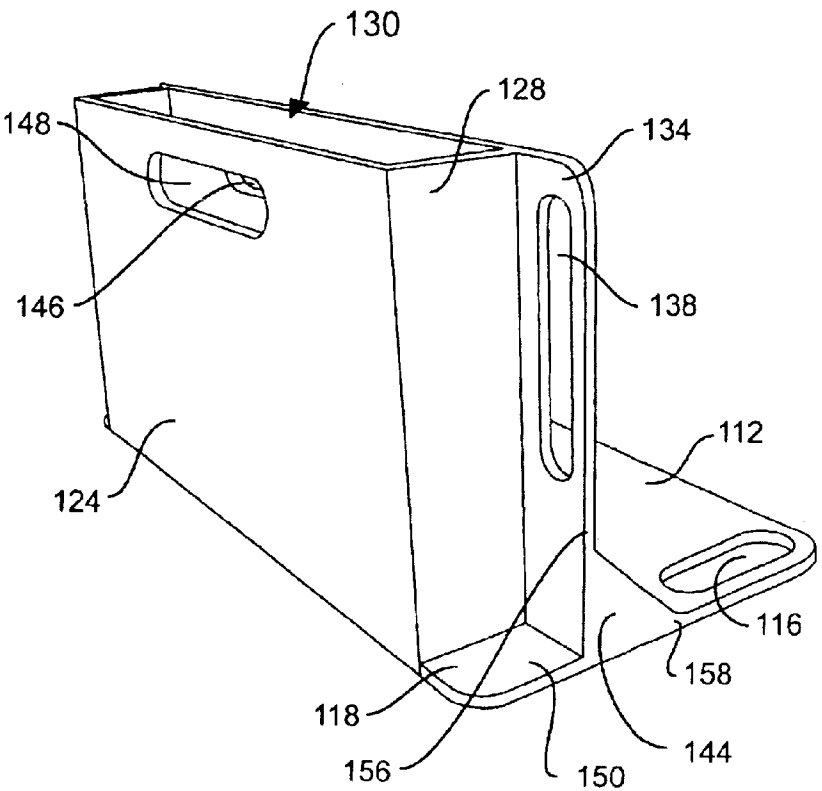
FIG. 2 illustrates a perspective view of the backside of the patient support illustrated in FIG. 1.

FIGS. 1 and 2, illustrate one embodiment of a rescue board patient support in accordance with the present invention and shown generally at 100. Patient support 100 includes a patient support portion 110 and a rescue board support portion 120.

Figure 3:
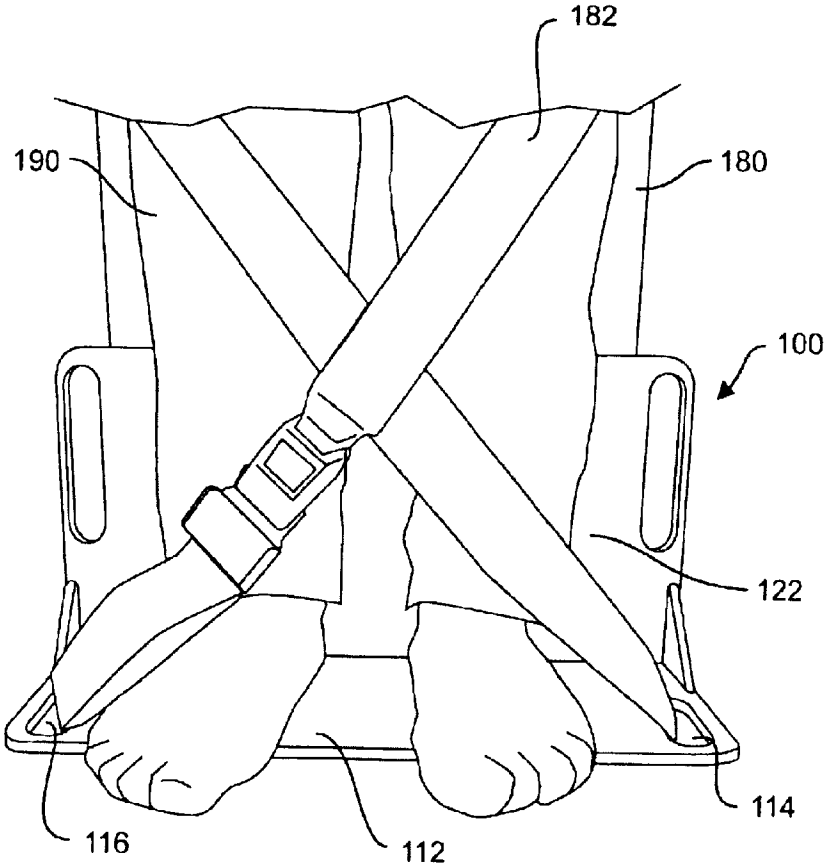
FIG. 3 illustrates one embodiment of a rescue board patient support in use on a rescue board, the patient support made in accordance with the present invention.

Board support portion 120 is a general box shape formed by a front wall 122, a back wall 124, and two sidewalls 126, 128. Together, walls 122, 124, 126 and 128 define an essentially rectangular opening 130 for receiving a rescue board as shown in FIG. 3. In one embodiment, rectangular opening (pocket) 130 is sized to allow for the insertion of standard size rescue boards. Those with skill in the art will recognize that the opening 130 may be sized to receive any width of rescue board, providing a level of versatility to the apparatus in the field.

Front wall 122 extends to form flange members 132 and 134. Flange member 132 defines an opening 136 and flange 134 defines opening 138. Openings 136 and 138 function as substitute handles to replace those covered by support 100 when support 100 is placed at the end of the rescue board during use. In one embodiment, front wall 122 defines an opening 146. In another embodiment back wall 124 defines opening 148. Opening 146, 148 is of a size and dimension to be used as a handle to carry the patient support 100. Those with skill in the art will recognize that either opening 146, opening 148 or both may be eliminated from the patient support or that the placement of the openings may be varied and still function as a handle.

Patient support (foot rest) portion 110 is substantially perpendicular to rescue board support portion 120. Patient support portion includes a shelf 112. Shelf 112 extends to form a base 118 for board support portion 120. Shelf 112 also defines openings 114, 116. Openings 114 and 116 are appropriately sized for receiving straps that are used to secure the patient to the rescue board, as shown in FIG. 3. Openings 114 and 116 may also be used as handles to carry patient support 100.

In one embodiment, patient support 100 includes side supports 142, 144. Side supports 142, 144 provide stability and strength to patient support 100. Side support 142 extends from adjacent an outside edge 152 of flange 132 to adjacent an outside edge 154 of shelf 112. Similarly, side support 144 extends from adjacent an outside edge 156 of flange 134 to adjacent an outside edge 158 of shelf 112. In one embodiment, side supports 142, 144 are triangular in shape. Those with skill in the art will recognize that the position, size and shape of the side supports may be varied to provide differing levels of structural support to patient support 100. In one embodiment, side supports are eliminated from the support.

In the preferred embodiment, patient support 100 is manufactured to be lightweight and compact in order to meet space and weight requirements for rescue vehicles. Patient support 100 may be composed of any suitable metallic based material, polymeric based material or combinations thereof. In the preferred embodiment, patient support 100 is composed of a material that is resistant to heat and corrosion, is light in weight and is shock resistant. Patient support 100 may be composed of a molded polymer. In one embodiment, patient support is manufactured using an injection molding method as is well known in the art. The preferred material may be, for example, acrylonitrile butadiene styrene (ABS) plastics resin or a polystyrene structural plastic as are known in the art. In another embodiment, patient support 100 is composed of a lightweight metal, for example, aluminum.

Patient support devices such as rescue boards, gurneys and stretchers are often manufactured to be able to support a specific minimum weight. This minimum weight is often determined and regulated by a governmental agency, for example, the Illinois Department of Transportation. In one embodiment, patient support 100 is manufactured to be able to support the same minimum weight required by regulation for the rescue board. In another embodiment, the patient support 100 is manufactured to support the industry standard minimum of 500 pounds for rescue boards. In another embodiment, the patient support is manufactured to support a greater amount of weight than the industry standard in order to meet the requirements of a greater number of localities.

Referring now to FIG. 3 where like elements have like reference numbers as those shown in FIGS. 1 and 2, FIG. 3 illustrates the use of the patient support apparatus 100 and is shown properly placed on a rescue board (back board) 180. In practice, the lower end (foot end) of the rescue board is inserted into the board receiving opening 130. The board may be in a vertical position or a horizontal position when the board is inserted into opening 130.

When the board is in the vertical position, the patient 190 is allowed to step onto the shelf portion 112 of the patient support with the patient's heels adjacent to the front wall 122 of the patient support. The patient may then be strapped onto the board and the board lowered to a horizontal position. To ease the movement of the board and patient into the horizontal position, the medical provider may place the toe of his shoe on a portion 149 or 150 of the base 118 that extends perpendicular to the sidewall 126, 128.

When the board is in the horizontal position, the patient may be placed on the board with the feet adjacent the shelf portion 112 and then strapped onto the board.

The patient support device is strapped to the board by threading the existing straps 182 of the board through openings 114 and 116 and securing the straps across the patient as is known in the art. The placement of the straps 182 secures the patient support and the patient to the board. The use of the existing straps attached to the rescue board allows users the option of using the patient support with any rescue board at their disposal.

The patient may then be picked up and carried to another location using the hand openings or handles present on the board as well as the replacement hand holes (openings) 136, 138 of the patient support. During transport, the patient is prevented from slipping off the end of the board by the shelf 112 of patient support portion 110. Shelf 112 also provides support for the patients feet if, during transport, the patient must be moved to a more vertical position to, for example, turn a corner or maneuver up or down a flight of stairs or a ladder.

The rescue board with the patient may then be transferred to, for example, a gurney to be transported to either a waiting vehicle (ambulance) or a medical care facility. Alternatively, the patient may be placed directly into a rescue vehicle. Once the patient is placed on the gurney, the straps securing the patient support to the rescue board may be released and the patient support removed from the board. At this point the patient's feet are accessible for any medically necessary test that may need to be performed as a matter of standard medical procedure.

Figure 4A:
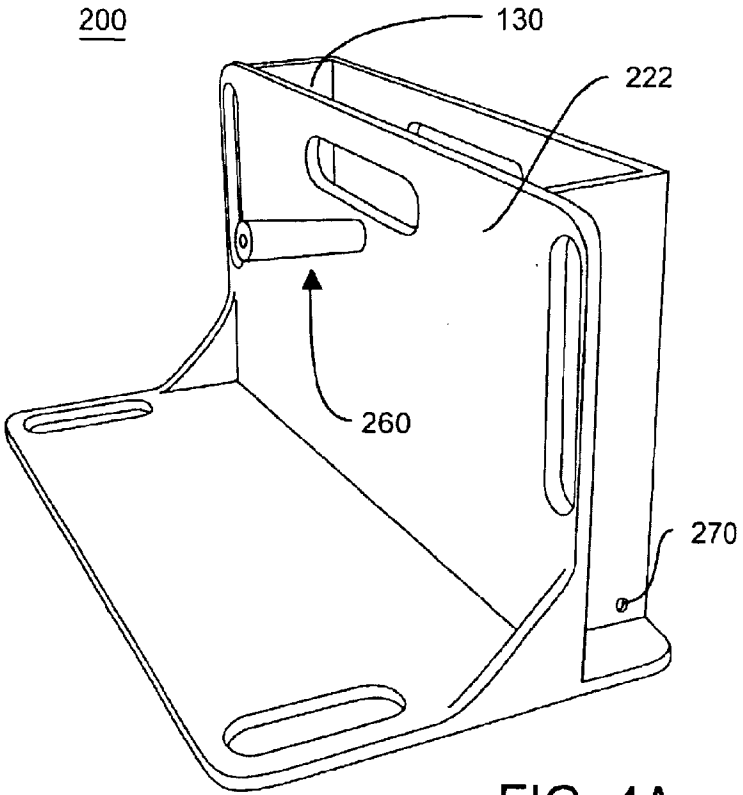
FIG. 4A illustrates another embodiment of the patient support according to the present invention.
Figure 4B:
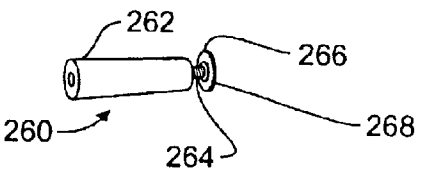
FIG. 4B illustrates a detail of the securing device illustrated in FIG. 4A.

Referring now to FIGS. 4A and 4B where like elements have like reference numbers as those of FIGS. 1 and 2, FIG. 4A illustrates another embodiment of a patient support made in accordance with the present invention, and shown generally at 200.

Patient support 200 is similar in structure to patient support 100 described above and shown in FIGS. 1 and 2. Patient support 200 includes board locking assembly 260. Board locking assembly 260 provides an additional means for securing the patient support 200 to the rescue board. In the preferred embodiment, the board locking assembly is used in conjunction with the straps of the rescue board to secure the patient support to the rescue board. Board locking assembly 260 is located substantially in the center of front wall 222. The location of board locking assembly 260 is preferably placed in the center so that the patient's feet are positioned on either side of the board locking assembly 260 during use of the patient support. Board locking assembly

260 is threadedly engaged with front wall 222 via a threaded opening (not shown) defined in front wall 222.

Referring to FIG. 4B, board locking assembly 260 includes handle 262, threaded member 264 attached to handle 262 and board contact member 266 operably attached to a distal end of threaded member 264. Board contact member 266 includes a substantially flat bearing surface 268. Board contact member 266 is able to move freely upon threaded member 264 until the bearing surface 268 contacts the board. In one embodiment, board contact member 266 is a swivel as is well known in the art. In another embodiment, board contact member is attached to the threaded member by a ball and socket connection as is well known in the art.

In practice, the rescue board (not shown) is placed within rectangular opening 130 as described above in FIG. 3. After placement of the patient support 200 on the rescue board, the handle 262 of the board locking assembly 260 is rotated to advance the contact member 266 toward the rescue board. The handle is rotated until the bearing surface 268 of the contact member is unable to advance further thereby securely locking the patient support to the rescue board. The patient may now be properly placed on and strapped to the board, as described above. Those with skill in the art will recognize that the locking assembly 260 may be actuated at any time after placement of the patient support on the rescue board.

In another embodiment of the present invention illustrated in FIG. 4A, a drain opening 270 may be placed in at least one of the walls forming the board support portion of the patient support 200. Drain opening 270 provides a means of draining liquid from the patient support. Liquid may enter the patient support during a decontamination procedure or during wet weather conditions. Those with skill in the art will recognize that the drain opening may be placed in locations other than that depicted and that the number of drain openings may be varied.

Those skilled in the art will recognize that patient support 100 may be fashioned in other manners. For example, patient support may include a hinged shelf, the hinge located to secure the shelf portion to the front wall of the board support.

Therefore, while the embodiments of the present invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. A patient support apparatus, comprising:

a back board receiving unit including a board support portion having a back board receiving pocket formed therein, said board support portion comprised of a front wall, a back wall, a first side wall, a second side wall and a base portion, the front wall including a first flange and a second flange, each of said flanges extending from the back board receiving pocket, and defining an opening forming a carrying handle; and a foot rest portion extending from the board support portion; and a back board removably received in the back board receiving pocket.

2. The apparatus of claim 1 further comprising a plurality of strap openings formed in the back board receiving unit.

3. The apparatus of claim 2 wherein the plurality of strap openings are formed in the foot rest portion.

4. The apparatus of claim 1 wherein the back board receiving unit further comprises a board locking assembly.

5. The apparatus of claim 4 wherein the board locking assembly lies in a plane parallel to the foot rest portion.

6. The apparatus of claim 1 wherein the back board receiving unit comprises a polymeric based material.

7. The apparatus of claim 6 wherein the polymeric material is acrylonitrile butadiene styrene plastics resin or polystyrene.

8. The apparatus of claim 1 wherein the back board receiving unit comprises a metallic based material.

9. The apparatus of claim 8 wherein the metallic based material is aluminum.

10. The apparatus of claim 1 wherein the foot rest portion is substantially perpendicular to the base portion.

11. The apparatus of claim 1 further comprising at least one drain opening.

12. The apparatus of claim 1 further comprising at least one toe-hold portion, the at least one toe hold portion substantially perpendicular to the sidewall of the board support portion.

13. The apparatus of claim 1 further comprising at least one support member extending perpendicularly between an outside edge of the flange and an outside edge of the foot rest portion.

14. A patient support apparatus comprising:

back board receiving unit means for removably receiving a back board said back board receiving unit means comprising a back board receiving pocket defined by a front wall, a back wall, a first side wall, a second side wall and a base portion, the front wall including a first flange and a second flange, each of said flanges extending from the back board receiving pocket, and defining an opening forming a carrying handle;

patient support means for supporting the feet of the patient; and a back board removably received in the back board receiving pocket.

15. The apparatus of claim 14 further comprising:

attachment means for fastening the back board to the receiving means.

16. The apparatus of claim 14 further comprising locking means for locking the back board to the back board receiving means.

* * * * *